US007930880B2

(12) United States Patent
Williams et al.

(10) Patent No.: US 7,930,880 B2
(45) Date of Patent: Apr. 26, 2011

(54) METHOD FOR TRIGGERING A REGENERATION EVENT IN A PARTICULATES FILTER OF AN INTERNAL COMBUSTION ENGINE

(75) Inventors: John D. Williams, New Palestine, IN (US); Tanto Sugiarto, W. Lafayette, IN (US); Thomas M. Harris, Waterloo, IA (US); George N. Simopoulos, Noblesville, IN (US)

(73) Assignee: Delphi Technologies, Inc., Troy, MI (US)

( * ) Notice: Subject to any disclaimer, the term of this patent is extended or adjusted under 35 U.S.C. 154(b) by 729 days.

(21) Appl. No.: 12/011,535

(22) Filed: Jan. 28, 2008

(65) Prior Publication Data

US 2009/0188242 A1 Jul. 30, 2009

(51) Int. Cl.
*F01N 3/00* (2006.01)

(52) U.S. Cl. ..... 60/295; 60/274; 60/276; 60/286; 60/290; 60/297

(58) Field of Classification Search ..... 60/295
See application file for complete search history.

(56) References Cited

U.S. PATENT DOCUMENTS

| | | | | |
|---|---|---|---|---|
| 6,735,941 | B2 | 5/2004 | Saito et al. | |
| 7,231,761 | B2 | 6/2007 | Okugawa | |
| 2006/0042237 | A1 * | 3/2006 | Nonoyama et al. | 60/297 |
| 2006/0059901 | A1 * | 3/2006 | Saito et al. | 60/297 |
| 2006/0225409 | A1 * | 10/2006 | Kuboshima et al. | 60/295 |

FOREIGN PATENT DOCUMENTS

JP 2003254042 A * 9/2003

* cited by examiner

*Primary Examiner* — Thomas E Denion
*Assistant Examiner* — Jason Shanske
(74) *Attorney, Agent, or Firm* — Thomas N. Twomey

(57) ABSTRACT

A method for triggering a new regeneration event in a soot-trapping particulates filter disposed in an exhaust gas stream of an internal combustion engine, comprising the steps of determining instantaneous engine speed and engine load; determining instantaneous mass fractions for wet soot and for dry soot in the exhaust gas stream for the instantaneous engine speed and load; determining instantaneous concentrations of wet and dry soot particles in the exhaust gas; determining the rates of accumulation of wet soot and dry soot in the particulates filter; determining the total amounts of wet soot and dry soot accumulated in said soot-trapping device during all engine operation conditions since the latest previous regeneration event; and triggering the new regeneration event when the total amount of wet soot and dry soot exceeds a permissible value.

5 Claims, 3 Drawing Sheets

WS = WET SOOT FRACTION
DS = DRY SOOT FRACTION (WHERE REGION I-IX CONTAINS ANY VALUE 0-1)

SOOT VOLATILITY INDEX TABLE

SOOT VOLATILITY INDEX TABLE

SOOT EMISSION TABLE (PPM)

METHOD FOR TRIGGERING A REGENERATION EVENT IN A PARTICULATES FILTER OF AN INTERNAL COMBUSTION ENGINE

TECHNICAL FIELD

The present invention relates to exhaust emission control systems for internal combustion engines; more particularly, to methods for regenerating a particulates filter for exhaust gas in an engine exhaust system; and most particularly, to a method for optimizing timing of such regeneration and for controlling temperature in a particulates filter during regeneration thereof to prevent thermal damage to the filter.

BACKGROUND OF THE INVENTION

Internal combustion engine exhaust emissions, and especially diesel engine exhaust emissions, have recently come under scrutiny with the advent of stricter regulations, both in the U.S. and abroad. While diesel engines are known to be more economical to run than spark-ignited engines, diesel engines inherently suffer disadvantages in the area of emissions. For example, in a diesel engine, fuel is injected during the compression stroke, as opposed to during the intake stroke in a spark-ignited engine. As a result, a diesel engine has less time to thoroughly mix the air and fuel before ignition occurs. The consequence is that diesel engine exhaust typically contains incompletely burned fuel known as particulate matter, or "soot".

It must be noted that other types of internal combustion engine ignition processes are also known to produce soot in the exhaust, for example, direct injection gasoline engines. Hence, the problem addressed by the present invention is broader than just diesel exhaust soot, although that is the largest application for the present invention at the present time. For this reason, the terms "catalytic diesel particulate filter (CDPF)" and "diesel particulate filter (DPF)" as used herein should not be limited to diesel engines but rather must be taken to mean a particulate filter for capturing soot particles in any internal combustion engine exhaust.

It is known to use catalytic particulate filters which physically trap soot particulates. However, such particulate filters progressively load up with accumulated soot and therefore must be repeatedly regenerated by burning off the trapped particulates, typically on a fixed schedule and by fuel and oxygen enrichment of the exhaust stream entering the CDPF and catalytically ignited in an integral diesel oxygen catalyst (DOC).

Typically, prior art regeneration systems are temperature based with the primary filter protection strategy being limitation of the quantity of soot allowed to accumulate. As shown below, such a strategy can under-utilize the filter capacity by frequent regeneration on a conservative schedule and thus result in a penalty in fuel economy.

A currently challenging durability issue in the CDPF art is cracking or melting of a CDPF substrate due to large temperature excursions within the bed of the filter during regeneration, especially when using an economical filter such as a cordierite monolith. These temperature excursions are caused by the exothermic reaction of carbon and oxygen due to the combined effects of the mass loading and distribution of wet volatile and dry soot within the CDPF, the operating condition of the engine, and the exhaust gas temperature and flow rate through the CDPF. Diesel engine exhaust temperatures are normally in the range of 200-500° C., depending in part on the amount of exhaust gas recirculation, throttle plate position (MVRV—Manifold Vacuum Regulator Valve) and fueling. These engine control parameters, in combination with the manipulation of both fuel quantity and timing in the main fueling and post fueling events, may be used to increase exhaust gas temperature in the range of 500-700° C. as an effective means of initiating a regeneration event and as a means of controlling exhaust gas temperatures supplied to the CDPF during the regeneration process. During regenerative events, when the exhaust gas contains sufficient available oxygen to support the $O_2$ transport process (typically, 5-11%) and an adequate (actual mass depends upon wet/dry soot ratio and total mass) non-homogeneous distribution of wet and dry soot is resident within the CDPF, a highly non-uniform uncontrolled reaction can occur within the CDPF. This rapid, non-uniform reduction of wet and dry soot within the CDPF under various conditions of engine load and exhaust gas temperature and flow may result in excessive thermal gradients and peak monolith temperatures that exceed the material capabilities of the substrate material. This combination of events (rapid oxidation and inadequate heat transfer due insufficient exhaust gas flow) can result in excessive filter temperature and/or temperature gradients, resulting in substrate failure.

A factor not recognized in prior art CDPF regeneration is the relative combustibility difference between "wet" soot and "dry" soot, both of which can be present in a CDPF. By "wet soot" is meant soot particles coated with residual diesel fuel, such as may be generated during periods of high engine load but low engine speed, for example when pulling a heavy vehicle load up a substantial incline in a relatively high gear. Conversely, dry soot may be generated during periods of low engine load and high engine speed, such as at constant highway vehicle speeds. Wet soot burns substantially hotter that dry soot during catalytic regeneration. Indeed, wet soot is inherently rich in hydrocarbons that can explosively ignite, either spontaneously or when regeneration is started, and create an intense exothermic reaction within the CDPF in which temperatures can rise rapidly and uncontrollably ("flash-over"). Further, such intense combustion may occur nonuniformly over a CDPF, creating thermal stresses that can cause cracking or melting of the monolith, resulting in filter failure. Such flash-over is analogous to a creosote fire in a wood stove or fireplace chimney flue.

U.S. Pat. No. 6,735,941 B2 discloses a method for calculating the total soot mass accumulated in a CDPF by measuring differential pressure across the CDPF. This method does not recognize the functional (combustibility) difference between wet soot and dry soot; does not determine the percentage of total soot that is wet soot; and does not provide a strategy for burning off the wet soot in a controlled manner before completing oxidation of the dry soot, to protect against thermal damage to a CDPF.

What is needed in the art is a method for continuously calculating the total soot load and the wet soot fraction of the soot load in a CDPF and determining a relative Combustibility Index for the overall soot content.

It is a principal object of the present invention to prevent damage to a CDPF substrate by overheating during regeneration thereof, by continuously calculating a Combustibility Index for the soot load within a CDPF.

It is a further object of the present invention to improve engine fuel economy by conducting CDPF regeneration only when needed, as indicated by the Combustibility Index, rather than on a fixed schedule.

SUMMARY OF THE INVENTION

Briefly described, a method in accordance with the invention for triggering a new regeneration event in a soot-trapping device disposed in an exhaust gas stream of an internal combustion engine comprises the steps of:

a) determining instantaneous engine speed and engine load;

b) determining instantaneous mass fractions for wet soot and for dry soot in said exhaust gas stream for said instantaneous engine speed and load;

c) determining instantaneous concentrations of wet and dry soot particles in said exhaust gas;

d) determining the rates of accumulation of wet soot and dry soot in said soot-trapping device;

e) determining the total amounts of wet soot and dry soot accumulated in said soot-trapping device during all engine operation conditions since the latest previous regeneration event; and f) triggering said new regeneration event when said total amounts of wet soot and dry soot exceed a permissible value.

BRIEF DESCRIPTION OF THE DRAWINGS

The present invention will now be described, by way of example, with reference to the accompanying drawing, in which.

DESCRIPTION OF THE PREFERRED EMBODIMENTS

The present invention recognizes that combustibility of a soot load in a CDPF at any point in time during operation of a diesel engine is a function of both the Total Soot Mass and the Wet Soot Percentage. In addition, a forecast of instantaneous combustibility in the near future may be made by determining the rate of change in the Wet Soot Percentage and the Equivalent Accumulation Rate of soot in the CDPF.

Figure 1:
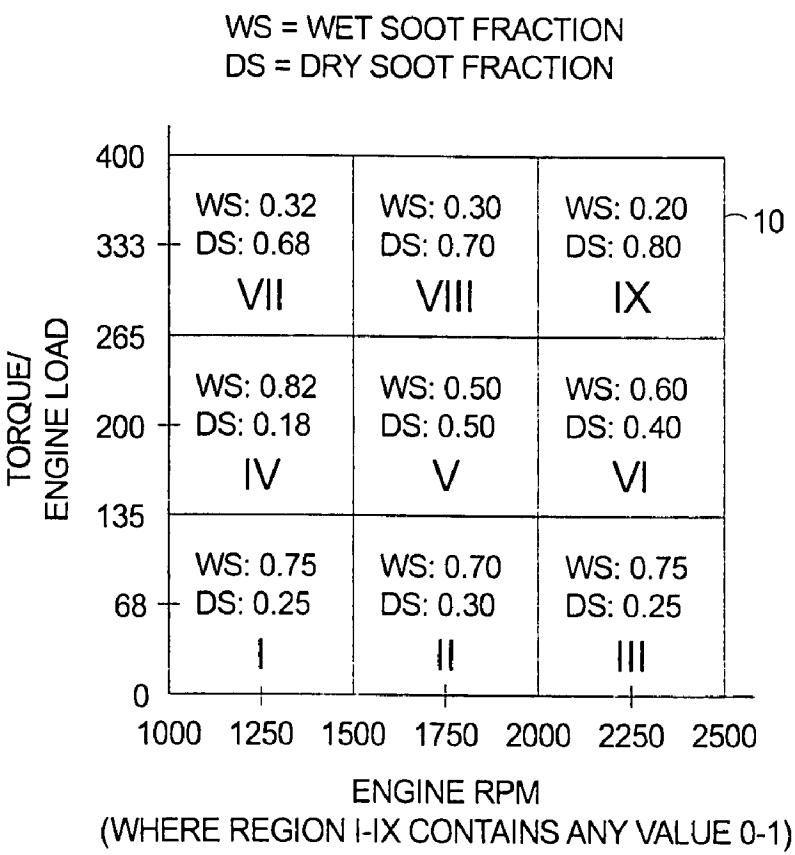
FIG. 1 is table showing percentages of wet soot and dry soot in diesel exhaust under varying engine operating conditions of speed and load; this table may be used as a means of determining instantaneous engine out volatility; in a full control embodiment, this table would be utilized in an interpolated format.

Referring to FIG. 1, the table 10 shows that the percent wet soot and percent dry soot that is produced and emitted per unit time by an engine under different operating conditions of speed and load, and can be used in a calculation of soot volatility. The soot fractions in each region will always total 1.0. The soot components produced by the engine are fundamentally related to the engine operating conditions based primarily on torque/engine load versus RPM (revolutions per minute). As engine power has a fundamental relationship with these parameters, the nature of the combustion occurring under various conditions of load affect both the amount and the chemical composition of the soot particulates that are formed based upon such combustion parameters as oxygen availability, flame front propagation and temperature, quenching, and various other reactions within the chamber environment. As such, the method disclosed herein relates the empirical productive soot output in the exhaust stream to the load conditions to which the engine is responding.

Figure 2:
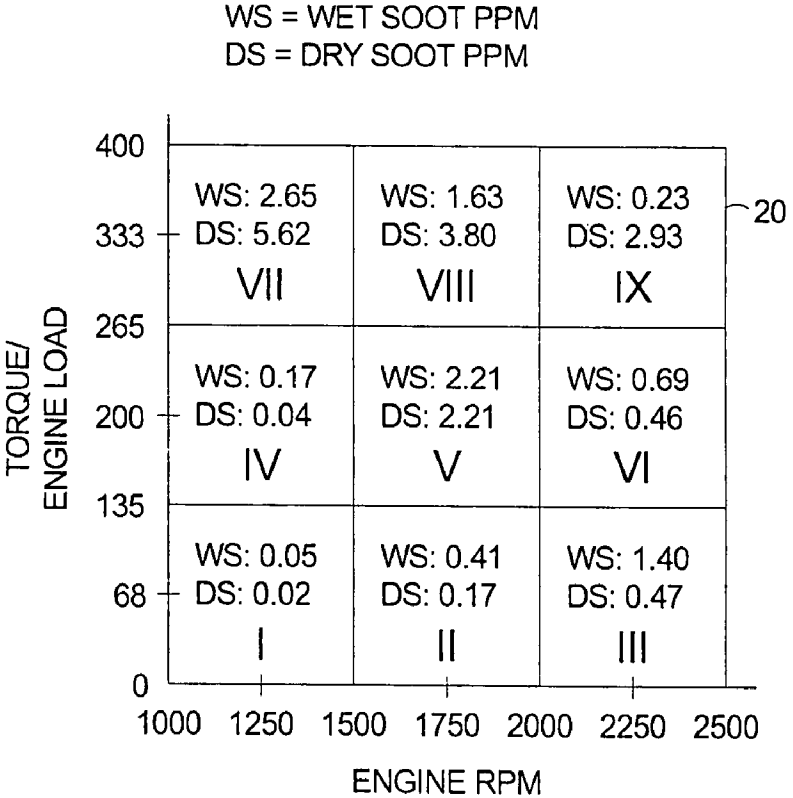
FIG. 2 is a table showing concentrations of wet soot and dry soot in diesel exhaust under the engine operating conditions shown in FIG. 1; this table may be used as a means of relating instantaneous wet soot equivalent accumulation rate (parts/million) as a function of instantaneous volatility index; in a full control embodiment, this table would be utilized in an interpolated format.

Presently, there exist no modeling or predictive representations that can accurately estimate exhaust stream particulate emissions or soot distribution within the DPF. However, as these tools are developed they may be directly applied to this methodology. Additionally, the selection of nine regions for the maps 10,20 depicted in FIGS. 1 and 2 is arbitrary and may be expanded to meet the control resolution requirements for a particular application. As the wet soot fraction, defining a Wet Soot Volatility Index value, is an indicator of soot volatility within a DPF, this parameter can be used as an indicator of flashover potential (excessive exothermic release) that exists based upon the total soot composition that is resident in the DPF at any time.

Referring to FIG. 2, once the primary engine map 10 for soot composition is known (FIG. 1), the fractional values can be applied through molar conversion to obtain the dry soot mass and wet soot mass components 20 in parts per million (ppm) of exhaust gas as a function of mass flow rate of air and fuel through the engine.

As any given accumulation of wet and dry soot produced by the engine is time dependent, the total mass of wet and dry soot per unit time can be determined by integration of the respective components (ppm or micrograms/sec) over discrete time steps within the control embodiment on the order of ten milliseconds (0.01 seconds) or less. Consequently, the mass quantity of both wet soot and dry soot can be determined for a measured period of operation. Additionally, since the effect of exhaust gas temperature and flow on wet soot phase conversion are known (conversion of wet soot in the CDPF to dry soot by exhaust drying), these integrators (up/down) can be modified to account for wet soot drying and reduction effects and allow for even greater accuracy.

Once the fractional relationship of wet soot and dry soot production for each region of FIGS. 1 and 2 is known and the complimentary soot mass is known, the soot composition and respective mass values resident on the filter can be accurately estimated for any given point in the DPF control cycle. This information can then be used to determine the best accumulation and regeneration strategy to be employed in order to minimize the potential for flashover that can result in excessive temperature rise, thermal gradients, or catastrophic filter failure. An additional benefit is realized from this strategy as the filter capacity can be efficiently utilized, the number of regeneration cycles minimized, and fuel penalty for active regenerations reduced.

Since volatility is the primary indicator for DPF control decisions in this strategy, the Effective Volatility of the soot emissions produced by the engine for any given time interval is arrived at by means of the following relationship:

To calculate effective_volatility; integrate Instantaneous volatility (Table I) over time;

$$\text{effective_volatility} = \frac{\int_t^{t+dt} \text{mass_flow} * \text{vol_index}(Tq, RPM) * \text{Total_ppm} * dt}{\int_t^{t+dt} \text{mass_flow} * \text{Total_ppm} * dt}$$

To calculate soot mass accumulated by DPF;

$$m_{soot_inside_DPF} = C_{eff} \int \text{mass_flow} * \text{ppm} * dt$$

Where: $C_{eff}$ = Filtration Efficiency
Total_ppm = Total soot parts per million; where:
Total_ppm = wet_soot_emission (Tq, RPM) + dry_soot_emission (Tq, RPM); Ref. FIG. 2

This measure of instantaneous effective volatility represents flammability of the physical soot composition accumulated in a DPF and is the indicator that is employed as a decision trigger in various embodiments of DPF control strategies. As effective volatility is a proportion of wet soot fraction to total soot, it will always fall between the values of 0-1.0. Once determined, this index value is a universal value within the control context regardless of the absolute magnitude of mass accumulation.

How is effective volatility used? Once the Instantaneous Volatility Index Value is known, it can be directly referenced to the Instantaneous Wet Soot Equivalent Accumulation Rate of mass production via the relationship indicated in FIG. 2 and the formula for ppm above.

Figure 3:
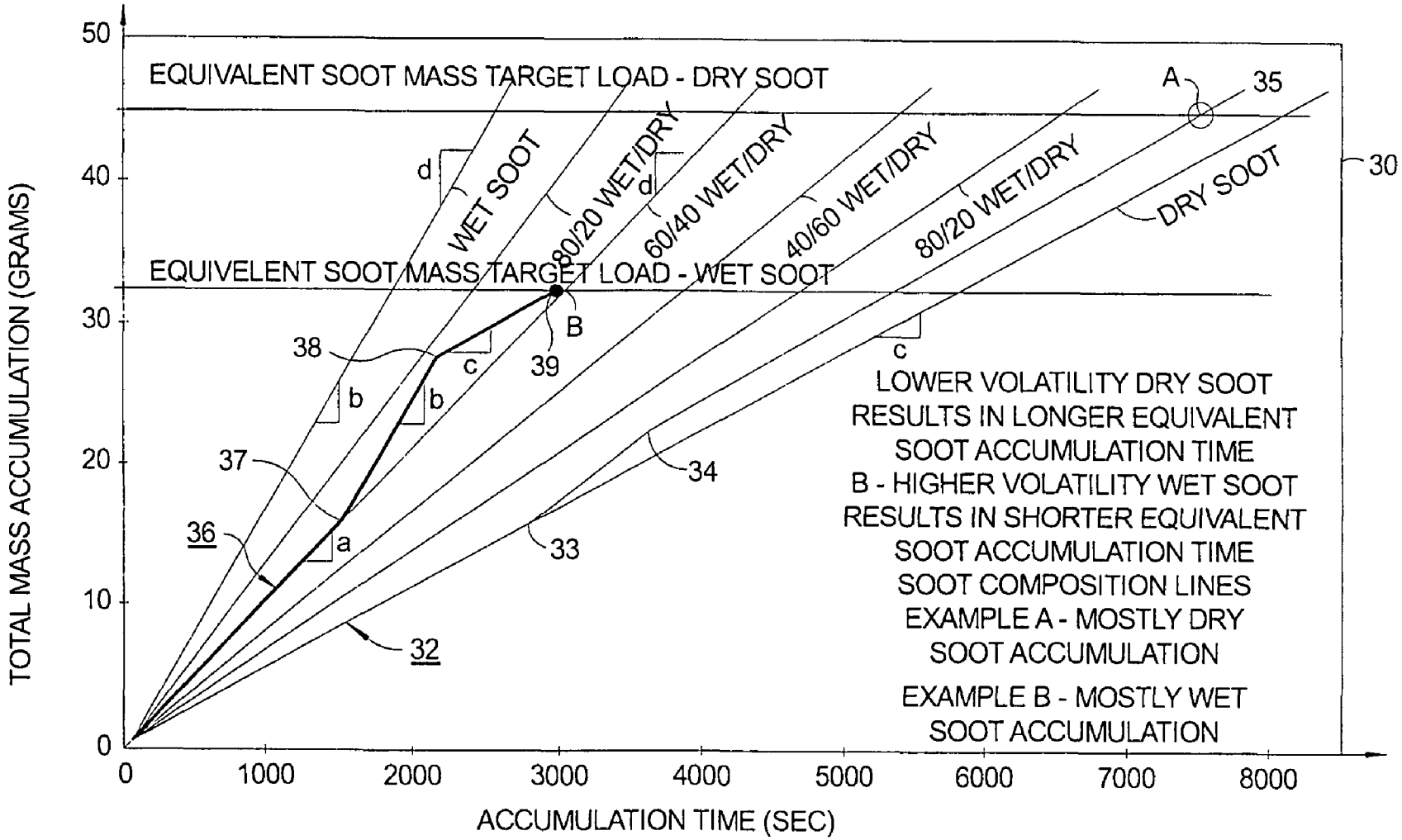
FIG. 3 is a set of graphs showing the allowable total mass accumulation as a function of wet/dry composition of the soot over a period of engine operation (accumulation time)

How can this virtual soot sensor be utilized? The Wet Soot Mass Up/Down Integrator 30 represented schematically in FIG. 3 continuously integrates the Instantaneous Wet Soot Equivalent Accumulation Rate in micrograms/sec. This allows for both the total soot and the total wet soot mass quantity produced by the engine over a given time period to be known. The Up/Down Integrator 30 incorporates a provision for discounting the portion of the wet soot that is driven out of solution or dried out over time as a function of exhaust gas flow and temperature. By integrating the components of wet and dry engine out soot mass over time as a function of load and speed, a more accurate means of soot load determination for downstream devices (not just the DPF) is known versus using a proxy measure such as delta-pressure. This enables higher storage utility of the DPF and results in a variable state control method indicated by FIG. 3, which thus is an Equivalent Soot Mass Integrator.

FIG. 3 is a representation of a multi-slope, multi-threshold control scheme that can be implemented once the instantaneous wet soot fraction and total soot mass is known. This knowledge enables a control scheme that can selectively utilize any of three different primary regeneration strategies based upon the volatility estimate of the soot load produced by the engine over a given time period:

- Strategy 1: Active Regen—A regeneration process wherein fuel (hydrocarbons) is added to the exhaust stream and oxidized across a Diesel Oxidation Catalyst to elevate the exhaust gas temperature to the ignition temperature of the soot mass contained within the DPF.
- Strategy 2: Opportunistic regen—A regeneration process wherein the normal operating condition of the engine produces sufficient hydrocarbons to elevate the exhaust gas temperature to the ignition temperature of the soot mass contained within the DPF.
- Strategy 3: Preemptive regen—A regeneration process wherein an early active or opportunistic regeneration is allowed to occur based upon the occurrence of a large proportion of wet soot being present in the DPF (a high value of effective-volatility). The term "early" should be taken to mean ahead of the next expected regeneration event.

Note that pre-emptive regen is necessary whenever adequate wet soot is present on the filter, although not necessarily the allowable based upon the Total Soot Mass Regen Target value, and the engine operating condition is atypical. Such a situation exists in an event such as a diesel pulling a heavy load with a relatively high wet soot mass on the filter. If this vehicle were to chance encounter a steep grade over an extended period of time, the engine will begin to operate at extreme power and rpm levels and produce extreme exhaust temperatures and emission products. This may be adequate to light off the Diesel Oxygen Catalyst and the soot load within the DPF in an uncontrolled manner. The wet soot quantity has not met the Target Soot Mass Regen Target value for the active regen process, but the engine operating condition is at an extreme operating point for an extended period, an outlier condition.

This is not the only such extreme condition. One cannot base all potential region heuristics on this case as the system would then encounter unnecessary regen cycles under normal, typical, conditions. However, provisions must be made for this type of control scenario as it will occur periodically and can result in a melted or cracked filter monolith if left undetected and uncontrolled.

In FIG. 3, a first example 32, shown as Case A, is a soot accumulation profile wherein dry soot is accumulated for the first 2700 seconds of engine operation. At point 33, the engine then shifts into a operating regime for the next 800 seconds wherein the soot comprises about 40/60 wet/dry. At point 34, the engine shifts back to the original dry soot operating condition. An Equivalent Soot Mass Target Load 35 (Point A) of 45 grams is reached after a total operating time of 7200 seconds, triggering a regeneration event before a dangerously combustible condition develops in the DPF.

A second example 36, shown as Case B, is a soot accumulation profile wherein 60/40 wet/dry soot is accumulated for the first 1500 seconds of engine operation. At point 37, the engine then shifts into a operating regime for the next 600 seconds wherein the soot comprises 100% wet soot. At point 38, the engine shifts to a dry soot operating condition. An Equivalent Soot Mass Target Load 39 (Point B) of 33 grams is reached after a total operating time of 2900 seconds, triggering a regeneration event before a dangerously combustible condition develops in the DPF.

How are effective volatility, integrated wet and dry soot mass and accumulated wet and dry soot mass values used in a grand control scheme? Once these parameters are known, it is possible to control a downstream device such as a DPF based upon a primary indicator rather than a proxy indicator such as delta-pressure. In this control method, the knowledge of the proportional relationship between wet (very volatile) soot and dry (less volatile) soot is used as a primary indicator of the need for DPF regeneration at any given time. If a relatively low quantity of total soot is resident on the filter monolith, but is composed of a high proportion of wet volatile soot, the control algorithm can intervene and prevent an uncontrolled flashover (high temperature thermal gradient) by initiating an active controlled regeneration process. Additionally, under certain circumstances dependent upon total soot mass, wet soot proportion and engine operating condition, this information can be used to allow an un-commanded, opportunistic regen to occur due to normal exhaust gas temperature rise without incurring the associated fuel penalty of an active regeneration, thus saving on fuel expenditure per unit of engine operating time. Finally, if the filter soot load accumulation is determined to be composed mostly of dry, less volatile soot, with an adequately low proportion of wet volatile soot, the accumulation period can be extended beyond any "scheduled" regeneration trigger to maximize the time between regenerations. This enables full utilization of the DPF capacity (high efficiency operation) resulting in a further reduced fuel penalty by minimizing the total number of regens required over a given operating cycle. This also has the associated benefit of reduced monolith and catalyst aging effects associated with large numbers of regeneration cycles and results in increased filter durability and longevity.

Figure 4:
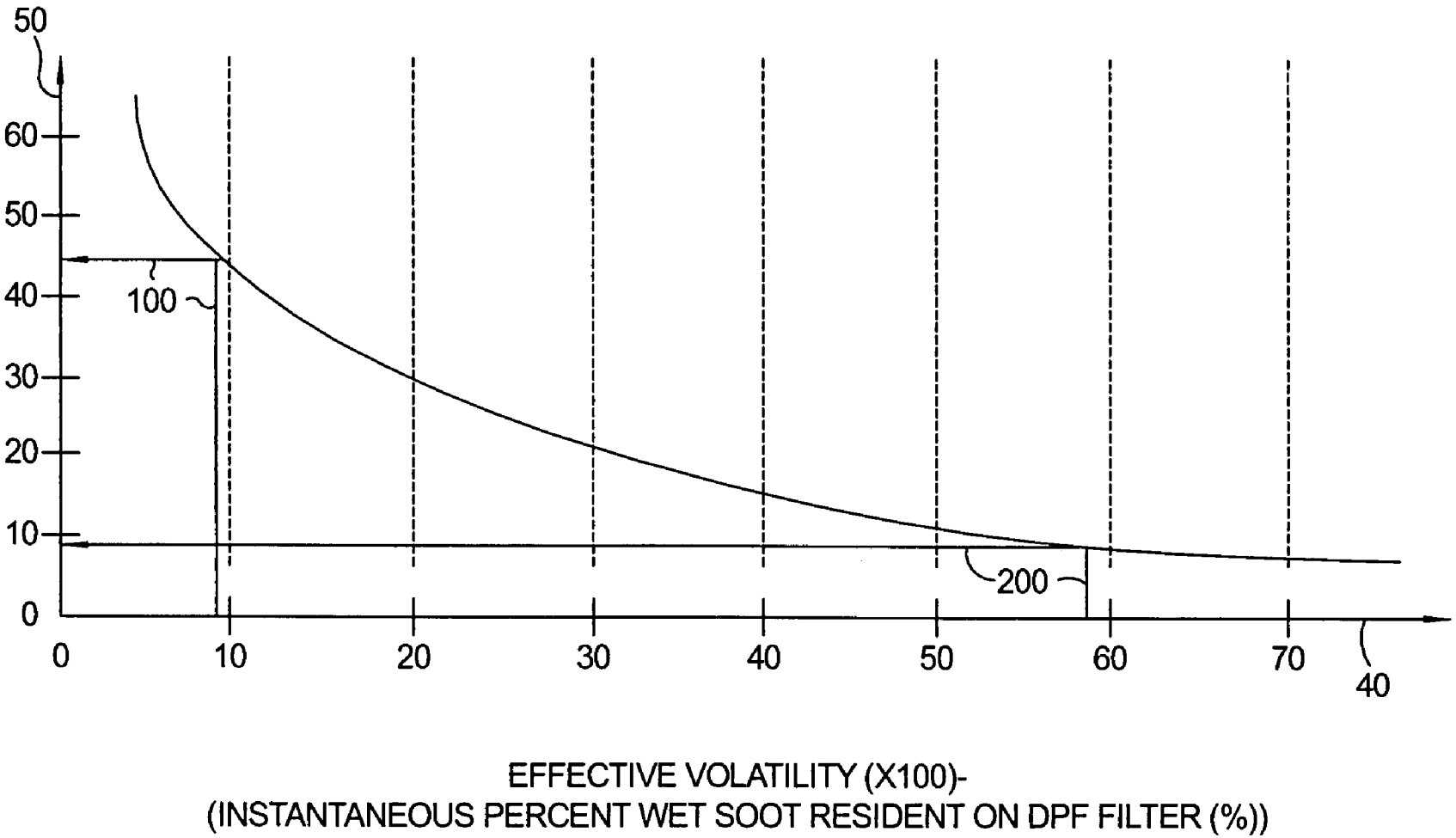
FIG. 4 is a graph showing the total allowable soot mass to trigger a regeneration event as a function of the instantaneous percent of wet soot resident on a DPF.

The threshold at which active regen intervention is required based upon the effective_volatility index-Instantaneous Percent Wet Soot Resident On DPF Filter (%) (fraction) is illustrated in FIG. 4. From the Regen Equivalent Soot Mass Target, it can be seen that as the proportion 40 of wet volatile soot resident within the filter at any given instant as a function of total soot present increases, the corresponding Total Soot Mass Regen Target 50 goes down. This is due to the necessity of controlling the rate at which exothermic energy is released within the filter. As the proportion of wet soot to total soot increases, the rate at which exothermic heat is released also increases. This rapid, uncontrolled release of heat is what leads high thermal stress gradients, cracked DPF monoliths, and degraded catalyst performance over time.

In a continuous time domain, the equation form is:

$$\text{wet_soot_accum_mass} = \int_{t}^{t+dt} MAF * \text{wet_soot_emission}(Tq, RPM) * dt$$

Where; $(Tq, RPM)$ are referenced from FIG. 2 Soot *ppm* Table

Where: MAF=instantaneous engine mass air flow value soot_emission=the value obtained from look up FIG. 2, interpolated (controller function) as a function of torque and rpm for greater accuracy.

dt=time interval.

Converting this equation form to a discrete time domain that is usable within a controls environment yields:

$$\text{Wet_soot_accum_mass} = \mathop{n}_{tN}^{t+dt} MAF_{t=tN} * \text{wet_soot_emission}(Tq, RPM)_{t=tN} * dt$$

Where; $(Tq, RPM)$ are referenced from FIG. 2 Soot *ppm* Table

Case 1: Integration series of instantaneous wet soot mass. The following example illustrates a low wet soot accumulation scenario:

Engine operation: low load and rpm operations predominately within Regions I, II, III, and IV in FIGS. 1 and 2.

$$\begin{aligned}\text{Wet_soot_accum_mass} = \mathop{n}_{t1}^{t+dt} [&(MAF_{t=t1} * \text{wet_soot_emission}(Tq, RPM)_{t=t1} * dt) + \\ &(MAF_{t=t2} * \text{wet_soot_emission}(Tq, RPM)_{t=t2} * dt) + \\ &(MAF_{t=t3} * \text{wet_soot_emission}(Tq, RPM)_{t=t3} * dt) + \\ &(MAF_{t=tN} * \text{wet_soot_emission}(Tq, RPM)_{t=tN} * dt)]\end{aligned}$$

Where; $(Tq, RPM)$ are referenced from FIG. 2 Soot *ppm* Table

Hence, utilizing the data values (non-interpolated) from FIG. 2:

From FIG. 2. Soot ppm Table

| Time | Region | Tq | RPM | ws (ppm) | ds (ppm) |
|---|---|---|---|---|---|
| $t_1$ | I | 68 | 1250 | 0.05 | 0.02 |
| $t_2$ | II | 68 | 1750 | 0.41 | 0.17 |
| $t_3$ | III | 68 | 2250 | 1.40 | 0.47 |
| $t_4$ | IV | 200 | 1250 | 0.17 | 0.04 |
| $t_5$ | II | 68 | 1750 | 0.41 | 0.17 |

$$\begin{aligned}\text{Wet_soot_accum_mass} = \prod_{T1\text{-}5}^{t+dt} [&(\text{MAF}_{t=t1} * 0.05\ \text{ppm} * \text{dt})_{t=t1} + \\ &(\text{MAF}_{t=t2} * 0.41\ \text{ppm} * \text{dt})_{t=t2} + \\ &(\text{MAF}_{t=t3} * 0.17\ \text{ppm} * \text{dt})_{t=t3} + \\ &(\text{MAF}_{t=t4} * 1.40\ \text{ppm} * \text{dt})_{t=t4} + \\ &(\text{MAF}_{t=t5} * 0.41\ \text{ppm} * \text{dt})_{t=t5} + \\ &(\text{MAF}_{t=tN} * \text{wet_soot_emission}\ (\text{Tq}, \text{RPM})_{t=tN} * \\ &\text{dt})_{t=tN}]\end{aligned}$$

(Note:
Data are drawn from FIG. 2, Region I, Region II, Region III, Region IV, and Region II consecutively.)

For a time step equal to 0.2 seconds, the first five elements of the series would represent the operational dither of wet soot production over a period of 1 second. Carrying this series forward over a time of N seconds would result in a wet soot mass value of 4.3 grams.

Concurrent with the calculation of wet soot mass accumulation, the dry soot mass accumulation is integrated by the same method in the form:

$$\begin{aligned}\text{dry_soot_accum_mass} = \mathop{n}_{t1}^{t+dt} [&(MAF_{t=t1} * \text{dry_soot_emission}(Tq, RPM)_{t=t1} * dt) + \\ &(MAF_{t=t2} * \text{dry_soot_emission}(Tq, RPM)_{t=t2} * dt) + \\ &(MAF_{t=t3} * \text{drt_soot_emission}(Tq, RPM)_{t=t3} * dt) + \\ &(MAF_{t=tN} * \text{dry_soot_emission}(Tq, RPM)_{t=tN} * dt)]\end{aligned}$$

Where; $(Tq, RPM)$ are referenced from FIG. 2 Soot *ppm* Table

This yields the following:

$$\text{dry_soot_accum_mass} = \int_{T1-5}^{t+dt}[(MAF_{t=t1} * 0.02\ ppm * dt)_{t=t1} + (MAF_{t=t2} * 0.17\ ppm * dt)_{t=t2} + (MAF_{t=t3} * 0.04\ ppm * dt)_{t=t3} + (MAF_{t=t4} * 47\ ppm * dt)_{t=t4} + (MAF_{t=t5} * 0.17\ ppm * dt)_{t=t5} + (MAF_{t=tN} * \text{dry_soot_emission}(Tq, RPM)_{t=tN} * dt)_{t=tN}]$$

(Note: Data are drawn from FIG. 2, Region I, Region II, Region III, Region IV, and Region II consecutively.)

For a time step equal to 0.2 seconds, the first five elements of the series would represent the operational dither of dry soot production over a period of 1 second. Carrying this series forward over a time of N seconds would result in a dry soot mass value of 38.7 grams.

As established above, the effective_volatility is a determinant control metric that equates the relative instantaneous volatility of the total soot load resident on the filter as:

$$\text{effective_volatility} = \frac{f\ \text{mass_flow} * \text{vol_index} * ppm * dt}{f\ \text{mass_flow} * ppm * dt}$$

(Note: mass_flow=total air and fuel throughput of the engine)

As the DPF accumulation times are significant, it is impractical to tabulate the entire time series data; for the purposes of example, the calculated effective volatility over N seconds for the sample case above results in an index value of 0.10.

Referencing Case 1 in FIG. 4 (item 100). Regen Equivalent Soot Mass Target: For an effective volatility value of 0.1, the allowable total mass accumulation target at which active regen is initiated would be equal to approximately 43 grams. This target mass is based on the relative heat release of wet soot and dry soot and the thermal margins necessary to protect the filter monolith from excessive thermal gradients and temperatures.

Case 2: Integration Series of Instantaneous Wet Soot Mass.

Alternately, if the engine is operating in a region of high load, low rpm, the index and accumulation values would be, respectively:

| | Time increment: | | | | |
|---|---|---|---|---|---|
| | t1 | t2 | t3 | t4 | t5 |
| Instantaneous engine out index (FIG. 1) | | | | | |
| Wet soot: | .50 | .60 | .32 | .30 | .20 |
| Dry soot: | .50 | .40 | .68 | .70 | .80 |
| (FIG. 2 or FIG. 3 in micrograms/s) | | | | | |
| Wet soot ppm: | 2.21 | 0.69 | 2.65 | 1.63 | 0.23 |
| Dry soot ppm: | 2.21 | 0.46 | 5.62 | 3.80 | 2.93 |

(Note: Data drawn from FIGS. 1 and 2, Region V, Region VI, Region VII, Region VIII, and Region VII consecutively.)

For a time step equal to 0.2 seconds, the first five elements of this series would represent the operational dither of wet soot production over a period of 1 second. Carrying this series forward over a time of N seconds would result in a wet soot mass value of 7.2 grams.

For the same period and a time step equal to 0.2 seconds, the first five elements of this series would represent the operational dither of dry soot production over a period of 1 second. Carrying this series forward over a time of N seconds would result in a dry soot mass value of 4.8 grams.

In this extreme illustration of extended high load operation, for the purposes of example, the calculated effective volatility over N seconds for the sample case above results in an index value of 0.60.

Referencing Case 2 in FIG. 4 (item 200). Regen Equivalent Soot Mass Target: For an effective volatility value of 0.60, the allowable total mass accumulation target at which active regen is initiated would be equal to approximately 10 grams. Due to the relative high wet soot load and potential for highly localized heat release, the DPF must be actively regenerated at a total soot load far less than that of the previous example. This target mass is based on the relative heat release of wet soot and dry soot and the thermal margins necessary to protect the filter monolith from excessive thermal gradients and temperature.

This, in essence, is the usefulness of the volatility index method of predicting soot production and hence the timing of the next required regeneration event. The metrics of instantaneous volatility and effective volatility are used in conjunction with traditional engine mapping or simulation to produce a method of emission estimation measures for downstream device control and tailpipe emissions.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for triggering a new regeneration event in a soot-trapping device disposed in an exhaust gas stream of an internal combustion engine, comprising the steps of:

a) determining instantaneous engine speed and engine load;

b) determining instantaneous mass fractions for wet soot and for dry soot in said exhaust gas stream for said instantaneous engine speed and load;

c) determining instantaneous concentrations of wet and dry soot particles in said exhaust gas;

d) determining the rates of accumulation of wet soot and dry soot in said soot-trapping device;

e) determining the total amounts of wet soot and dry soot accumulated in said soot-trapping device during all engine operation conditions since the latest previous regeneration event; and f) triggering said new regeneration event when said total amounts of wet soot and dry soot exceed a permissible value.

2. A method in accordance with claim 1 wherein said engine is selected from the group consisting of diesel fuel fired and gasoline fired.

3. A method in accordance with claim 1 wherein said soot-trapping device is a diesel particulate filter.

4. A method in accordance with claim 3 wherein said diesel particulate filter includes a catalyst.

5. An internal combustion engine comprising a soot-trapping device disposed in an exhaust stream of said engine, wherein said soot-trapping device is regenerated in accordance with a method including the steps of:

a) determining instantaneous engine speed and engine load;

b) determining instantaneous mass fractions for wet soot and for dry soot in said exhaust gas stream for said instantaneous engine speed and load;

c) determining instantaneous concentrations of wet and dry soot particles in said exhaust gas;

d) determining the rates of accumulation of wet soot and dry soot in said soot-trapping device;

e) determining the total amounts of wet soot and dry soot accumulated in said soot-trapping device during all engine operation conditions since the latest previous regeneration event; and f) triggering said new regeneration event when said total amounts of wet soot and dry soot exceed a permissible value.

* * * * *